US011366419B2

(12) United States Patent
Ohashi

(10) Patent No.: US 11,366,419 B2
(45) Date of Patent: Jun. 21, 2022

(54) IMAGE FORMING APPARATUS

(71) Applicant: KYOCERA Document Solutions Inc., Osaka (JP)

(72) Inventor: Hiroaki Ohashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/385,464

(22) Filed: Jul. 26, 2021

(65) Prior Publication Data

US 2022/0035301 A1 Feb. 3, 2022

(30) Foreign Application Priority Data

Jul. 30, 2020 (JP) ..... JP2020-129232

(51) Int. Cl.
*G03G 15/00* (2006.01)
*G03G 15/16* (2006.01)

(52) U.S. Cl.
CPC ..... *G03G 15/80* (2013.01); *G03G 15/161* (2013.01)

(58) Field of Classification Search
CPC ..... G03G 15/80; G03G 15/161
See application file for complete search history.

(56) References Cited

U.S. PATENT DOCUMENTS

2011/0286759 A1* 11/2011 Ichihashi ..... G03G 15/1665 399/90
2013/0322935 A1 12/2013 Ichihashi et al. ..... 399/314

FOREIGN PATENT DOCUMENTS

JP 2011-242657 A 12/2011

* cited by examiner

*Primary Examiner* — Clayton E. LaBalle
*Assistant Examiner* — Michael A Harrison
(74) *Attorney, Agent, or Firm* — Stein IP, LLC

(57) ABSTRACT

An image forming apparatus includes a connection mechanism in electrical contact with a contact. The connection mechanism includes a terminal member, a power supplying member, an insulating member, and a holding member. The terminal member makes contact with the contact. The power supplying member feeds electric power to the contact via the terminal member and urges the terminal member toward the contact. The insulating member covers the terminal member. The holding member holds the terminal member covered with the insulating member. The terminal member, at a tip end portion of it that projects from the holding member, makes contact with the contact. The insulating member covers at least an entire region, except a contact portion with the contact, of the terminal member that projects from the holding member.

5 Claims, 3 Drawing Sheets

IMAGE FORMING APPARATUS

INCORPORATION BY REFERENCE

This application is based upon and claims the benefit of priority from the corresponding Japanese Patent Application No. 2020-129232 filed on Jul. 30, 2020, the entire contents of which are hereby incorporated by reference.

BACKGROUND

The present disclosure relates to an image forming apparatus.

In image forming apparatuses such as copiers and printers, various components such as a photosensitive drum, a developing portion, and a fixing portion are operated in coordination with each other to form an image on a recording medium such as paper. To these components, electric power is fed from a high-voltage circuit board.

For example, a known image forming apparatus includes a rotary bias terminal that is electrically connected to a primary transfer roller, a main body bias terminal that is electrically connected to a power supply, and a compression spring that electrically connects the rotary bias terminal and the main body bias terminal together. Opposite ends of the compression spring in the axial direction abut on the main body bias terminal and the rotary bias terminal respectively, and thereby the main body bias terminal and the rotary bias terminal are electrically connected together. Thus, a voltage application path from the main body bias terminal to the rotary bias terminal is formed, and a voltage application path from the power supply to the primary transfer roller is formed.

SUMMARY

According to one aspect of the present disclosure, an image forming apparatus includes a connection mechanism which electrically makes contact with a contact. The connection mechanism includes a terminal member, a power supplying member, an insulating member, and a holding member. The terminal member is an electrically conductive rod-shaped member and makes contact with the contact. The power supplying member is electrically conductive, and it feeds electric power to the contact via the terminal member and urges the terminal member toward the contact. The insulating member covers the terminal member. The holding member holds the terminal member covered with the insulating member. The terminal member, at a tip end portion of it that projects from the holding member, makes contact with the contact. The insulating member covers at least the entire region, except a contact portion with the contact, of the terminal member that projects from the holding member.

DETAILED DESCRIPTION

Embodiments of the present disclosure will be described below with reference to the accompanying drawings. The present disclosure is, however, not limited to what is specifically described below.

Figure 1:
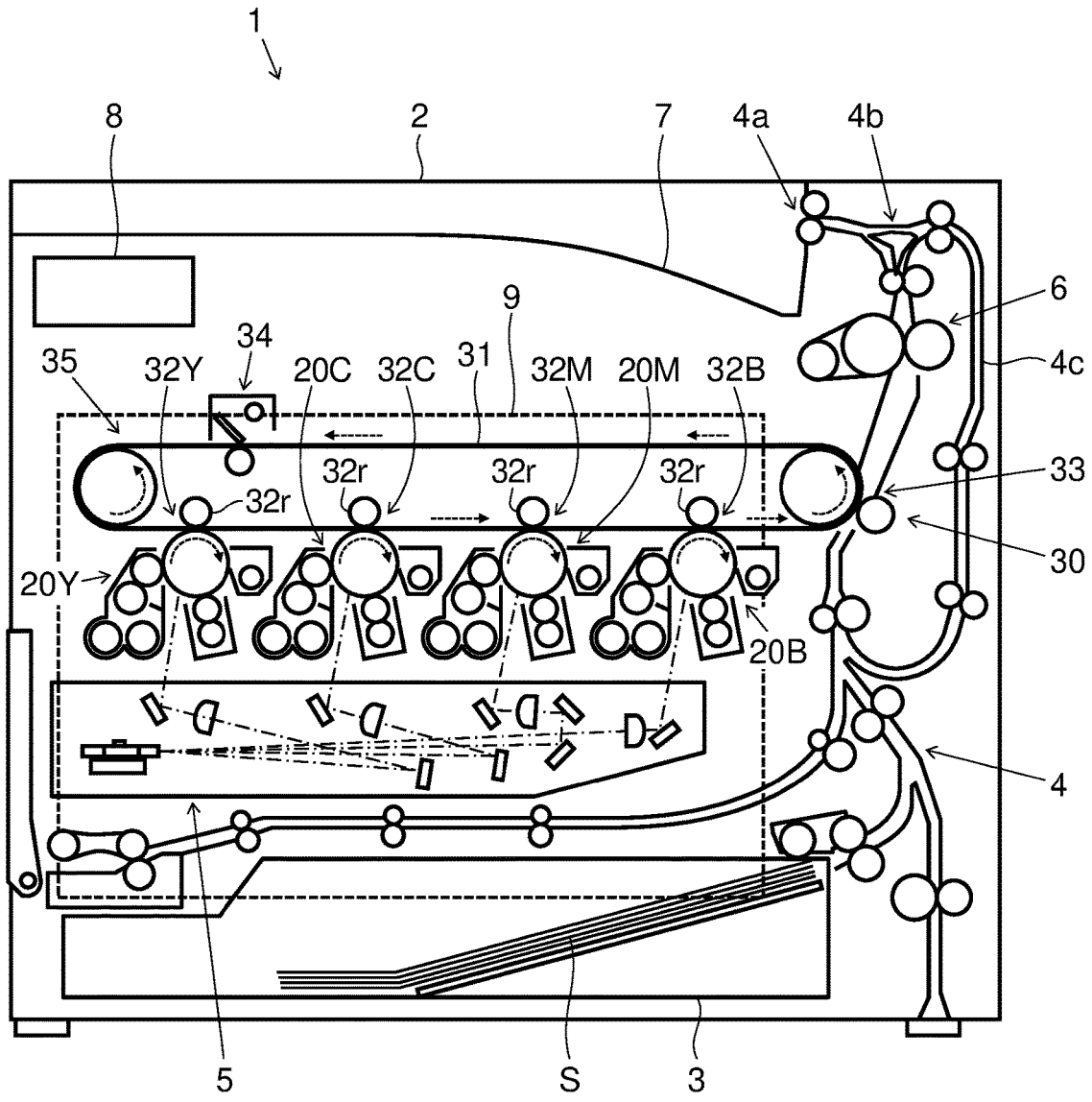
FIG. 1 is a schematic sectional front view showing a structure of an image forming apparatus according to an embodiment of the present disclosure.

FIG. 1 is a schematic sectional front view showing the structure of an image forming apparatus 1 according to an embodiment. One example of the image forming apparatus 1 according to the embodiment is a color printer of a tandem-type which transfers a toner image onto a sheet S using the intermediate transfer belt 31. The image forming apparatus 1 may be what is called a multifunction peripheral provided with the functions of, for example, printing, scanning (image reading), and facsimile transmission.

As shown in FIG. 1, the image forming apparatus 1 includes, in its main body 2, a sheet feeding portion 3, a sheet conveying portion 4, an exposure portion 5, an image forming portion 20, a transfer portion 30, a fixing portion 6, a sheet discharge portion 7, and a control portion 8.

The sheet feeding portion 3 stores a plurality of sheets S and, during printing, feeds them out one after another separately. The sheet conveying portion 4 conveys a sheet S fed out from the sheet feeding portion 3 to a secondary transfer portion 33 and then to the fixing portion 6, and then discharges the sheet S after fixing through a sheet discharge port 4*a* to the sheet discharge portion 7. When two-side printing is performed, the sheet conveying portion 4 switches, with a branch portion 4*b*, the conveying direction of the sheet S after fixing on its first side to an inverting conveying portion 4*c*, and conveys the sheet S to the secondary transfer portion 33 and then to the fixing portion 6 once again. The exposure portion 5 shines, toward the image forming portion 20, laser light that is controlled based on image data.

The image forming portion 20 is arranged under the intermediate transfer belt 31. The image forming portion 20 includes an image forming portion for yellow 20Y, an image forming portion for cyan 20C, an image forming portion for magenta 20M, and an image forming portion for black 20B. These four image forming portions 20 have basically similar structures. Thus, in the following description, the letters "Y", "C", "M", and "B" distinguishing different colors may be omitted unless distinction is needed.

The four image forming portions 20 each includes a photosensitive drum, a charging portion, a developing portion, and a drum cleaning portion. The charging portion electrically charges the outer circumferential face of the photosensitive drum to a predetermined potential. The exposure portion 5 exposes to light the outer circumferential face of the photosensitive drum charged by the charging portion to form on it an electrostatic latent image of the document image. The developing portion develops the electrostatic latent image by feeding toner to it to form a toner image. The four image forming portions 20 form toner images of different colors respectively.

The transfer portion 30 includes an intermediate transfer belt 31, primary transfer portions 32Y, 32C, 32M, and 32B, a secondary transfer portion 33, and a belt cleaning portion 34. The intermediate transfer belt 31 is arranged above the four image forming portions 20. The intermediate transfer belt 31 is an endless intermediate transfer member which is supported so as to be rotatable in a predetermined direction (counter-clockwise in FIG. 1) and to which the toner images formed on the four image forming portions 20 are sequentially superposed on each other and thereby primarily transferred. The four image forming portions 20 are arranged in what is called a tandem formation in which they are arranged in a row from upstream to downstream in the rotation direction of the intermediate transfer belt 31.

The primary transfer portions 32Y, 32C, 32M, and 32B are arranged across the intermediate transfer belt 31 over the image forming portions for different colors 20Y, 20C, 20M, and 20B. Over the four image forming portions 20, primary transfer rollers 32*r* are respectively arranged across the intermediate transfer belt 31. The secondary transfer portion 33 is arranged upstream of the fixing portion 6 in the sheet conveying direction in the sheet conveying portion 4 and downstream of the four image forming portions 20 in the rotation direction of the intermediate transfer belt 31 in the transfer portion 30. The belt cleaning portion 34 is arranged upstream of the four image forming portions 20 in the rotation direction of the intermediate transfer belt 31.

The transfer portion 30 further includes an intermediate transfer unit 35. The intermediate transfer unit 35 includes, for example, at least an intermediate transfer belt 31, a plurality of rollers around which the intermediate transfer belt 31 is rotatably stretched, and four primary transfer rollers 32*r*, and these components are integrated into a single unit. The intermediate transfer unit 35 can be mounted in and dismounted out of the apparatus main body 2, and it can be, for example, drawn out horizontally at the front side of the apparatus main body 2.

A toner image is primarily transferred to the outer circumferential face of the intermediate transfer belt 31 in the primary transfer portions for different colors 32Y, 32C, 32M, and 32B. As the intermediate transfer belt 31 rotates, the toner images on the four image forming portions 20 are sequentially superposed on each other and thereby transferred to the intermediate transfer belt 31 with predetermined timing. In this way, a color toner image with the toner images of four colors, namely yellow, cyan, magenta, and black, superposed together is formed on the outer circumferential face of the intermediate transfer belt 31. The drum cleaning portion, after primary transfer, performs cleaning by removing deposits such as toner left on the outer circumferential face of the photosensitive drum.

The color toner image on the outer circumferential face of the intermediate transfer belt 31 is transferred to a sheet S conveyed in synchronism by the sheet conveying portion 4 at the secondary transfer nips formed in the secondary transfer portion 33. The belt cleaning portion 34, after secondary transfer, performs cleaning by removing deposits such as toner left on the outer circumferential face of the intermediate transfer belt 31.

The fixing portion 6 heats and presses the sheet S to which the toner image has been transferred to fix the toner image on the sheet S.

The control portion 8 includes a CPU, an image processing portion, a storage portion, and other electronic circuits and components (none of these are illustrated). The CPU, based on control programs and data stored in the storage portion, controls the operation of different components provided in the image forming apparatus 1 to perform processing related to the functions of the image forming apparatus 1. The sheet feeding portion 3, the sheet conveying portion 4, the exposure portion 5, the image forming portion 20, the transfer portion 30, and the fixing portion 6 individually receive commands from the control portion 8 and coordinate to perform printing on the sheet S.

First Embodiment

Figure 2:
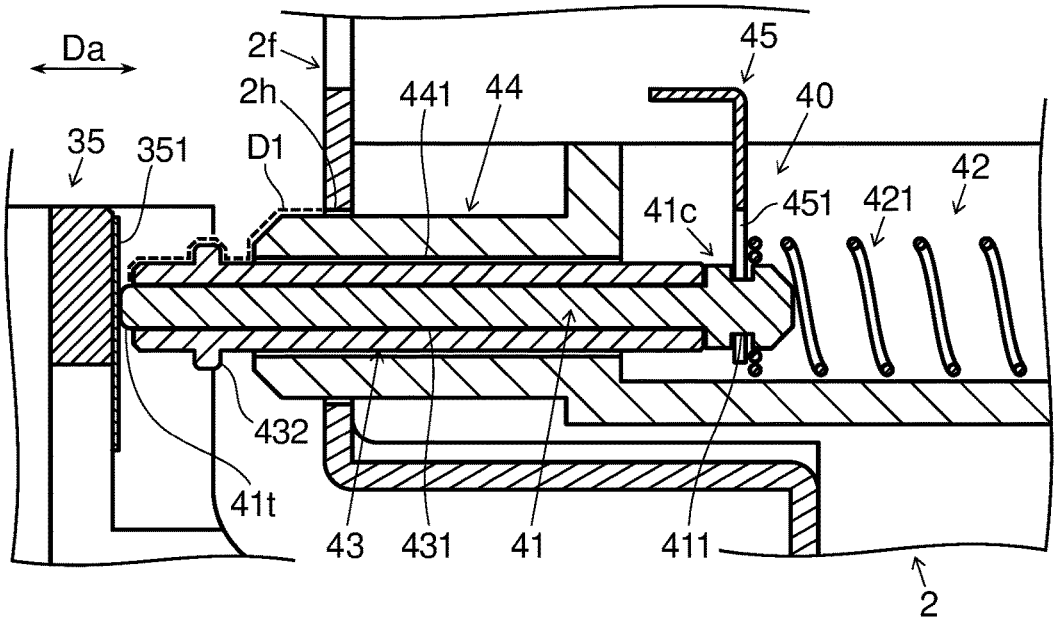
FIG. 2 is a vertical sectional side view of and around a connection mechanism in the image forming apparatus according to a first embodiment of the present disclosure.
Figure 3:
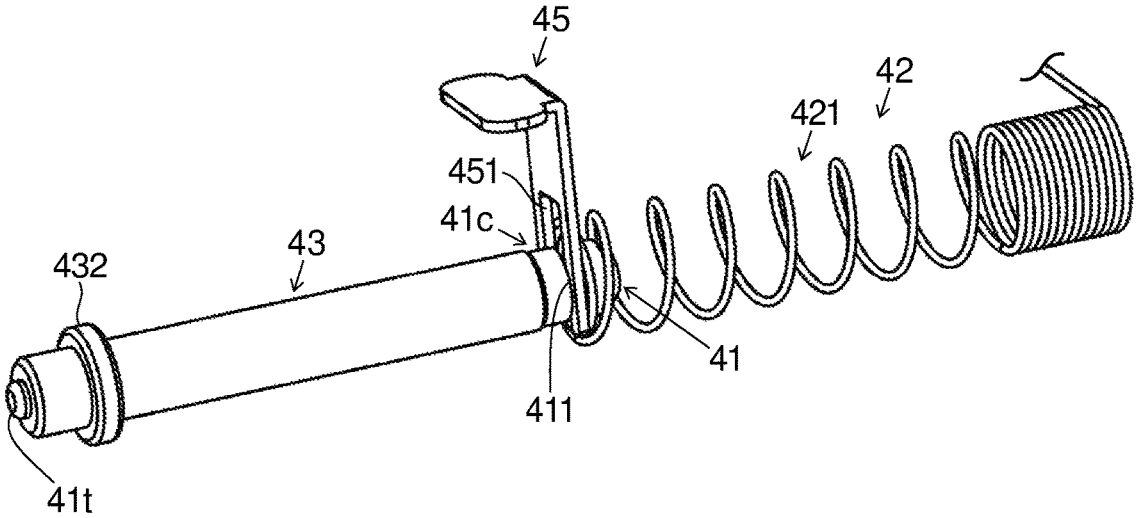
FIG. 3 is a perspective view showing some components of the connection mechanism in FIG. 2.

Next, a connection mechanism 40 in an image forming apparatus 1 according to a first embodiment will be described in detail with reference to FIG. 2 and FIG. 3 in addition to FIG. 1. FIG. 2 is a vertical sectional side view of and around the connection mechanism 40 in the image forming apparatus 1 of the first embodiment. FIG. 3 is a perspective view showing some of the components of the connection mechanism 40 in FIG. 2.

The image forming apparatus 1 includes, as shown in FIGS. 1, 2, and 3, a connection mechanism 40 and a high-voltage circuit board 9. The connection mechanism 40 and the high-voltage circuit board 9 are arranged, for example, behind the intermediate transfer unit 35, near the rear face of the image forming apparatus 1. That is, the apparatus main body 2 includes the connection mechanism 40 and the high-voltage circuit board 9.

The connection mechanism 40 is electrically connected to the high-voltage circuit board 9 and to the intermediate transfer unit 35. The connection mechanism 40 feeds electric power from the high-voltage circuit board 9 to the intermediate transfer unit 35.

The intermediate transfer unit 35 includes a contact 351. The contact 351 is arranged on the back face of the intermediate transfer unit 35 and faces the connection mechanism 40. In this embodiment, the contact 351 is composed of a metal flat spring of which the elastic force acts in the mounting-dismounting direction Da of the intermediate transfer unit 35 with respect to the apparatus main body 2. The contact 351 can be, for example, a jumper lead or the like formed of a bare metal material.

The connection mechanism 40 is arranged behind the intermediate transfer unit 35, adjacent to a frame 2*f* of the apparatus main body 2. The frame 2*f* is formed in the shape of a plate that extends in the left-right direction (in the depth direction with respect to the plane of FIG. 2) and in the up-down direction of the apparatus main body 2. The connection mechanism 40 faces and electrically makes contact with the contact 351 on the intermediate transfer unit 35. The connection mechanism 40 includes a terminal member 41, a power supplying member 42, an insulating member 43, and a holding member 44.

The terminal member 41 is an electrically conductive (for example, metal) member in the shape of a rod that extends in the mounting-dismounting direction Da of the intermediate transfer unit 35 with respect to the apparatus main body 2. The terminal member 41 is arranged in a tip end portion of the connection mechanism 40 in the mounting-dismounting direction Da of the intermediate transfer unit 35, and is inserted in an opening 2*h* provided in the frame 2*f* One end of the terminal member 41 in the mounting-dismounting direction Da of the intermediate transfer unit 35 projects out of the opening 2*h* toward the intermediate transfer unit 35. The terminal member 41 makes contact with the contact 351. The other end of the terminal member 41 in the mounting-dismounting direction Da of the intermediate transfer unit 35 is electrically connected to the power supplying member 42.

The power supplying member 42 is formed of an electrically conductive (for example, metal) wire material. One end of the power supplying member 42 is connected to an end portion of the terminal member 41 in the mounting-dismounting direction Da of the intermediate transfer unit 35. The other end of the power supplying member 42 is electrically connected to the high-voltage circuit board 9. The power supplying member 42 feeds electric power to the contact 351 via the terminal member 41.

The power supplying member 42 includes an urging member 421. The urging member 421 is formed by bending a wire material into the shape of a coil and has a function of a compression coil spring. More specifically, the urging member 421 has, for example, the shape of an irregular-pitched (two-stage-pitched) coil spring with a non-linear load-compression relationship. The axis of the coil constituting the urging member 421 extends along the mounting-dismounting direction Da of the intermediate transfer unit 35. In one end portion of the urging member 421, an end portion of the terminal member 41 is inserted inside the coil, and is connected to the terminal member 41. The urging member 421 urges the terminal member 41 toward the contact 351 in the mounting-dismounting direction Da of the intermediate transfer unit 35.

An insulating member 43 is formed of, for example, electrically insulating resin and covers the terminal member 41. More specifically, the insulating member 43 is formed in a cylindrical shape that extends along the mounting-dismounting direction Da of the intermediate transfer unit 35. The insulating member 43 has a hole 431 that penetrates it along the mounting-dismounting direction Da of the intermediate transfer unit 35. In the hole 431, the rod-shaped terminal member 41 is inserted along the mounting-dismounting direction Da of the intermediate transfer unit 35. The insulating member 43 is arranged on the outer circumference of the terminal member 41.

The holding member 44 is formed of, for example, electrically insulating resin in a cylindrical shape that extends along the mounting-dismounting direction Da of the intermediate transfer unit 35. The holding member 44 has a hole 441 that penetrates it along the mounting-dismounting direction Da of the intermediate transfer unit 35. In the hole 441, the terminal member 41 covered with the insulating member 43 is inserted along the mounting-dismounting direction Da of the intermediate transfer unit 35. The opposite ends of the terminal member 41 in the mounting-dismounting direction Da of the intermediate transfer unit 35 project from the holding member 44. The holding member 44 holds the terminal member 41 covered with the insulating member 43. The holding member 44 projects out of the opening 2*h* in the frame 2*f* toward the intermediate transfer unit 35.

A tip end portion 41*t* of the terminal member 41 on the intermediate transfer unit 35 side in the mounting-dismounting direction Da of the intermediate transfer unit 35 projects toward the intermediate transfer unit 35 from the holding member 44. The terminal member 41 makes contact with the contact 351 at the tip end portion 41*t* that projects from the holding member 44. The insulating member 43 covers at least the entire region, except a contact portion (the tip end portion 41*t*) with the contact 351, of the terminal member 41 that projects from the holding member 44.

According to the above structure, the terminal member 41 that makes contact with the contact 351 is covered with the insulating member 43 over the entire region that projects from the holding member 44 except the contact portion (tip end portion 41*t*) with the contact 351. This increases the creepage distance (broken line D1 in FIG. 2) from the contact portion (tip end portion 41*t*) of the terminal member 41 with the contact 351 to the frame 2*f* on the holding member 44 side, and this helps suppress electric leakage from the contact portion (tip end portion 41*t*) with the contact 351 toward the holding member 44. Thus, in the connection mechanism 40 that feeds electric power by making contact with the contact 351, it is possible to suppress electric leakage.

An end portion of the terminal member 41 on the high-voltage circuit board 9 side (right side in FIGS. 2 and 3) in the mounting-dismounting direction Da of the intermediate transfer unit 35, that is, a connecting portion 41*c* of the terminal member 41 with the power supplying member 42, projects from the holding member 44 in a direction away from the intermediate transfer unit 35. The connecting portion 41*c* of the terminal member 41 is not covered with the insulating member 43. The insulating member 43 covers the entire surface of the terminal member 41 except the contact portion (tip end portion 41*t*) with the contact 351 and the connecting portion 41*c* with the power supplying member 42.

According to the above structure, the surface of the terminal member 41 is covered with the insulating member 43 over a wide area. Thus, it is possible to effectively suppress electric leakage in the connection mechanism 40.

The insulating member 43 has a rib 432. The rib 432 is arranged in a region of the insulating member 43 that projects from the holding member 44. The rib 432 is formed in the shape of a ring that extends in the radial direction of the terminal member 41 which intersects with the direction in which the terminal member 41 projects. With this construction, it is possible to increase the creepage distance D1 from the tip end portion 41*t* of the terminal member 41 to the frame 2*f* Thus, it is possible to improve the effect of suppressing electric leakage in the connection mechanism 40.

The connection mechanism 40 further includes a connection aid member 45. The connection aid member 45 is fixed to the connecting portion 41*c* of the terminal member 41 with the power supplying member 42. The connection aid member 45 is an electrically conductive (e.g., metal) plate-form member that extends along the up-down direction and along the width direction (in the depth direction with respect to the plane of FIG. 2) that intersects with the axial direction of the terminal member 41. The connection aid member 45 has a top part of it bent in an L shape toward the intermediate transfer unit 35. The connection aid member 45 has a cutaway portion 451.

The cutaway portion 451 is arranged in a lower part of the connection aid member 45, near the connecting portion 41*c* of the terminal member 41. The cutaway portion 451 is arranged in a middle part of the connection aid member 45 in the width direction (in the depth direction with respect to the plane of FIG. 2) and extends upward from the lower end of the connection aid member 45 over a predetermined length. The terminal member 41 includes a groove 411 formed in an annular shape in the connection portion 41*c*. The connection aid member 45 is, with the cutaway portion 451 inserted in the groove 411 in the terminal member 41, fixed to the connecting portion 41*c* of the terminal member 41.

An end part of the connecting portion 41*c* of the terminal member 41 on the power supplying member 42 side is inserted through the coil of the urging member 421 of the power supplying member 42. The connection aid member 45 inserted in the connecting portion 41*c* of the terminal member 41 is arranged on the intermediate transfer unit 35 side with respect to the urging member 421 of the power supplying member 42. The connection aid member 45 makes contact with the urging member 421 of the power supplying member 42.

According to the above structure, it is possible to keep, via the connection aid member 45, adequate electrical contact between the terminal member 41 and the power supplying member 42. Thus, it is possible to suppress contact failure between the terminal member 41 and the power supplying member 42. When the intermediate transfer unit 35 is not mounted in the apparatus main body 2, if the terminal member 41 is urged by the power supplying member 42, the connection aid member 45 is caught on the holding member 44. This helps prevent the terminal member 41 from coming off the holding member 44.

Second Embodiment

Figure 4:
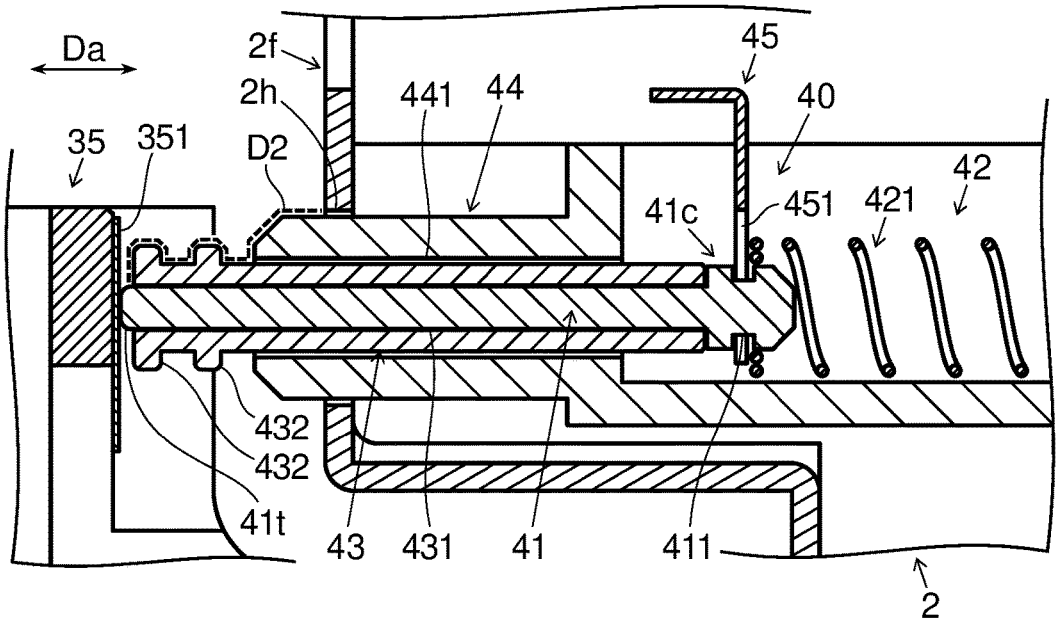
FIG. 4 is a vertical sectional side view of and around a connection mechanism in an image forming apparatus according to a second embodiment of the present disclosure.
Figure 5:
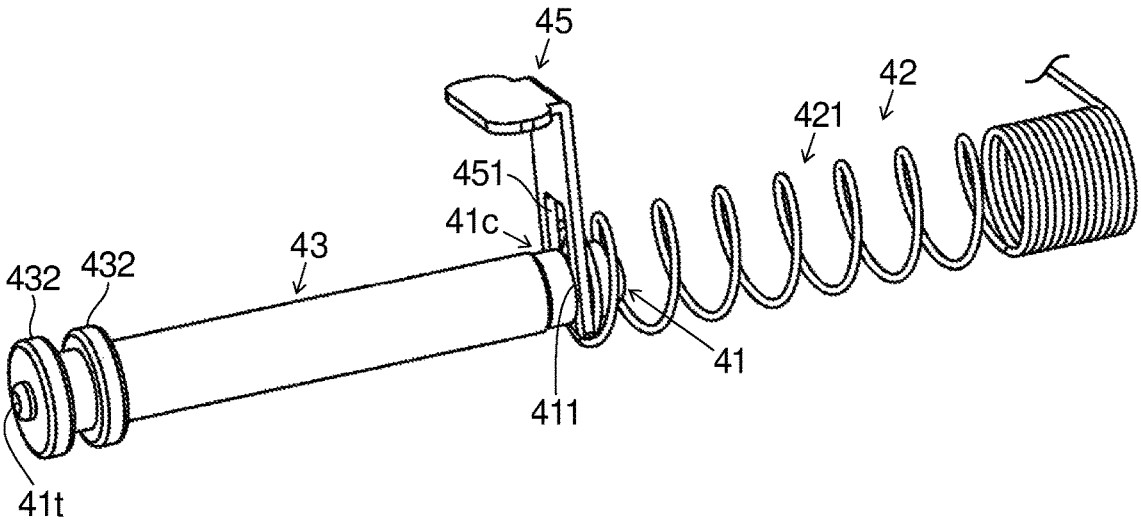
FIG. 5 is a perspective view showing some components of the connection mechanism in FIG. 4.

Next, a connection mechanism 40 in an image forming apparatus 1 according to a second embodiment will be described with reference to FIGS. 4 and 5. FIG. 4 is a vertical sectional side view of and around the connection mechanism 40 in the image forming apparatus 1 of the second embodiment. FIG. 5 is a perspective view showing some of the components of the connection mechanism 40 in FIG. 4. The second embodiment is basically constructed similarly to the first embodiment described previously. Accordingly, such elements as find their counterparts in the embodiment described previously are assigned the same reference signs as used previously and their description may be omitted.

The image forming apparatus 1 according to the second embodiment includes the connection mechanism 40 shown in FIGS. 4 and 5. The connection mechanism 40 includes a terminal member 41, a power supplying member 42, an insulating member 43, and a holding member 44.

The insulating member 43 has two ribs 432. The two ribs 432 are arranged in a region of the insulating member 43 that projects from the holding member 44. The two ribs 432 are arranged at a predetermined interval along the projection direction of the terminal member 41. The rib 432 is formed in the shape of a ring that extends in the radial direction of the terminal member 41 which intersects with the direction in which the terminal member 41 projects.

According to the above structure, by changing the structure of the terminal member 41 and the insulating member 43, it is possible to freely change the creepage distance (broken line D2 in FIG. 4) from the contact portion (tip end portion 41*t*) of the terminal member 41 with the contact 351 to the frame 2*f* on the holding member 44 side. Thus, it is possible, without changing the amount of projection of the holding member 44 with respect to the frame 2*f*, to significantly increase the creepage distance D2 from the tip end portion 41*t* of the terminal member 41 to the frame 2*f*. Thus, by applying the connection mechanism 40 of this embodiment to, for example, a conventional image forming apparatus, it is possible, without changing the construction of the apparatus main body and the intermediate transfer unit, to cope with higher voltages of supplied electric power.

The size (diameter, thickness) and the number of the rib 432 can be freely modified as necessary. Thus, it is possible to increase, while saving space, the creepage distance D2 from the tip end portion 41*t* of the terminal member 41 to the frame 2*f*. Thus, it is possible to make the image forming apparatus 1 compact.

The description given above of embodiments of the present disclosure is in no way meant to limit the scope of the present disclosure; the present disclosure can be implemented with any modifications made without departing from the spirit of the present disclosure.

For example, while in the embodiments described above, the connection mechanism 40 is arranged near the back face of the image forming apparatus 1 to exchange electric power between the high-voltage circuit board 9 and the contact 351 of the intermediate transfer unit 35, this is not meant as any limitation to such an arrangement. The connection mechanism 40 may be arranged elsewhere, or electric power may be exchanged between any other components.

While in the embodiment described above, the image forming apparatus 1 is assumed to be a color-printing image forming apparatus of what is called a tandem type in which images in a plurality of colors are formed while being sequentially superposed on each other, this is not meant as any limitation to that and similar types. The image forming apparatus may be a color-printing image forming apparatus of any type other than a tandem type, or may be an image forming apparatus for monochrome printing.

What is claimed is:

1. An image forming apparatus comprising a connection mechanism which electrically makes contact with a contact, wherein the connection mechanism includes an electrically conductive rod-shaped terminal member which makes contact with the contact, an electrically conductive power supplying member which feeds electric power to the contact via the terminal member and which urges the terminal member toward the contact, an insulating member which covers the terminal member, and a holding member which holds the terminal member covered by the insulating member, the terminal member makes contact with the contact at a tip end portion of the terminal member that projects from the holding member, and the insulating member covers at least an entire region of the terminal member that projects from the holding member except a contact portion of the terminal member with the contact.

2. The image forming apparatus according to claim 1, wherein the insulating member covers an entire surface of the terminal member except the contact portion of the terminal member with the contact and a connecting portion of the terminal member with the power supplying member.

3. The image forming apparatus according to claim 1, wherein the insulating member has, in a region thereof that projects from the holding member, a ring-form rib extending in a radial direction of the terminal member which intersects with a projection direction of the terminal member.

4. The image forming apparatus according to claim 1, further comprising an electrically conductive connection aid member which is fixed to the terminal member and with which the power supplying member makes contact.

5. The image forming apparatus according to claim 1, further comprising:

an apparatus main body including the connection mechanism; and an intermediate transfer unit which has the contact and which can be mounted in and dismounted out of the apparatus main body.

* * * * *